United States Patent [19]

Roos et al.

[11] Patent Number: 4,813,886

[45] Date of Patent: Mar. 21, 1989

[54] MICROWAVE DISTRIBUTION BAR

[75] Inventors: Mark D. Roos, San Carlos; Walter J. Messmer, III, San Jose, both of Calif.

[73] Assignee: EIP Microwave, Inc., San Jose, Calif.

[21] Appl. No.: 36,614

[22] Filed: Apr. 10, 1987

[51] Int. Cl.[4] ..... H01R 17/18

[52] U.S. Cl. ..... 439/578; 439/43; 439/928

[58] Field of Search ..... 439/578–585, 439/920, 49, 50, 51, 52, 53, 54; 333/254, 255, 260, 33, 99 R

[56] References Cited

U.S. PATENT DOCUMENTS

| | | | |
|---|---|---|---|
| 3,241,000 | 3/1966 | Roslyn, Jr. | 439/54 |
| 3,295,092 | 12/1966 | Newman et al. | 439/50 |
| 3,308,469 | 3/1967 | Drabowitch | 333/33 |
| 4,227,094 | 10/1980 | Semur et al. | 439/50 |
| 4,358,174 | 11/1982 | Dreyer | 439/578 |
| 4,580,862 | 4/1986 | Johnson | 439/585 |

*Primary Examiner*—David Pirlot

*Attorney, Agent, or Firm*—Nilsson, Robbins, Dalgarn, Berliner, Carson & Wurst

[57] ABSTRACT

A microwave device including various electromagnetically isolated components assembled with a microwave distribution bar in a single housing. A microwave distribution bar is formed to distribute microwave energy to those individual components which are selectively connected thereto.

4 Claims, 2 Drawing Sheets

FIG. 3
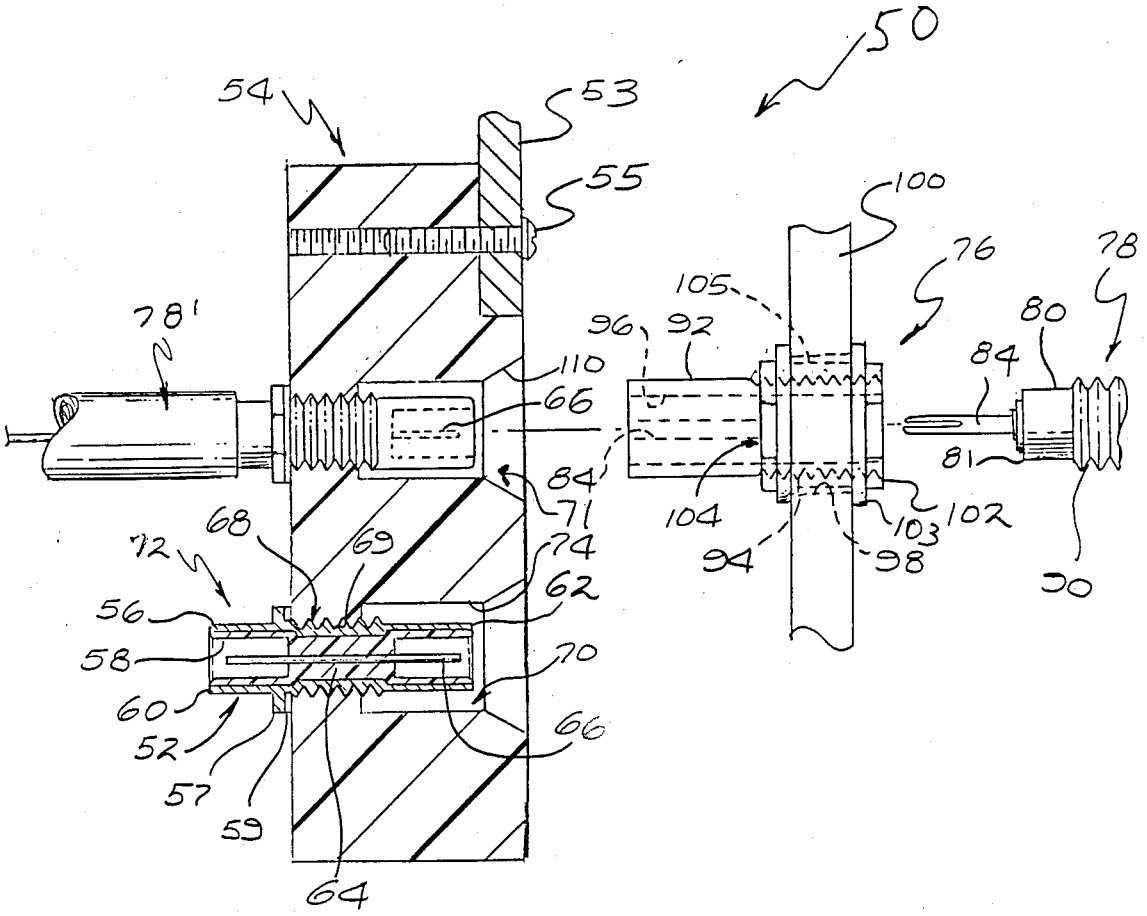
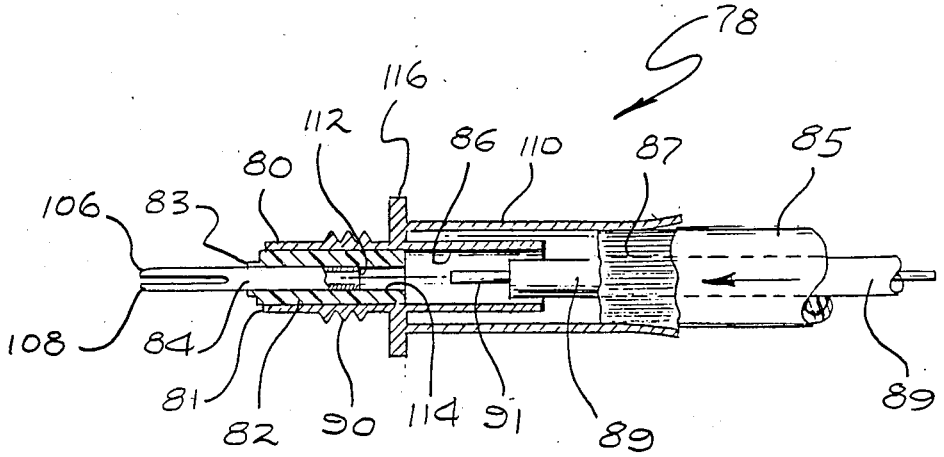
FIG. 4

MICROWAVE DISTRIBUTION BAR

BACKGROUND OF THE INVENTION

The present invention relates to microwave devices, more specifically to devices for distributing microwave energy from one component to other of the various components of such microwave devices.

Microwave devices include various types of devices, e.g., microwave antenna and microwave network analysis testing devices. Prior to assembling a microwave device, e.g., an antenna, the various components of the system are tested for various characteristics. These characteristics include frequency modulation, noise, power distribution, transmission and impedance. It is necessary to test the various components for these characteristics in order to insure the overall performance of the device.

These components are presently tested using microwave network analysis equipment. This type of equipment is constructed to shield its various constituents from extraneous microwave radiation which would affect the results of the component calibration. It is also important to minimize any microwave energy leakage to the external environment from any of the network analysis equipment. This shielding is typically performed by housing the various parts of the network analysis equipment separately in electrically conductive material, e.g. aluminum. The individually housed parts are then assembled and supported in some manner to construct the overall system. This separately electromagnetically isolates the individual parts of the system; however, each of these separate parts must be interconnected to allow for the distribution of microwave energy.

The necessary interconnections between the numerous parts of the system is presently made using microwave cables and wave guides. That is, individual cables are connected to each part of the system using known connectors. While this type of arrangement provides the necessary interconnections, the resulting system is cumbersome and difficult to manage. Furthermore, the various cables may affect the microwave testing calibrations of the device being tested.

It would thus be beneficial to provide a device to which the various parts of a microwave network analysis system may be selectively interconnected and which functions to distribute microwave energy.

SUMMARY OF THE INVENTION

The present invention achieves these objectives by providing a microwave distribution bar which is assembled with the various components of a microwave device in a single housing. Each of the components are independently electromagnetically isolated from each other and are selectively interconnected to the distribution bar.

The microwave distribution bar is formed with multiple ports. Each of the individual microwave device components may be selectively connected to one or more of these ports. Microwave energy is then transferred to and/or from each component through the respective port.

BRIEF DESCRIPTION OF THE DRAWINGS

The present invention may be better understood and its advantages apparent to those skilled in the art by reference to the accompanying drawings, wherein like reference numerals refer to like elements in the several figures, and wherein:

FIG. 3 is a partially cross-sectioned view of the microwave distribution bar of FIG. 2 along 4—4, illustrating a pair of connectors which are each mounted in apertures defining the ports and various coaxial cable mounted connectors which are releasably coupled thereto in accordance with an embodiment of the invention; and FIG. 4 is a partially perspective lateral view of a coaxial cable mounted connector.

DESCRIPTION OF THE INVENTION

The present invention is directed to a microwave distribution bar which is housed together with the various components of a microwave system. The microwave distribution bar includes numerous ports to which the various components are selectively coupled and to which microwave cables or other suitable conduits are selectively coupled to distribute microwave energy to and/or from each component.

While the present invention will be described in relation to a microwave network analysis system, which includes various circuit boards having various components mounted thereon, the microwave distribution bar of the invention may be used with any device which requires the distribution of microwave energy from one component to another.

Figure 1:
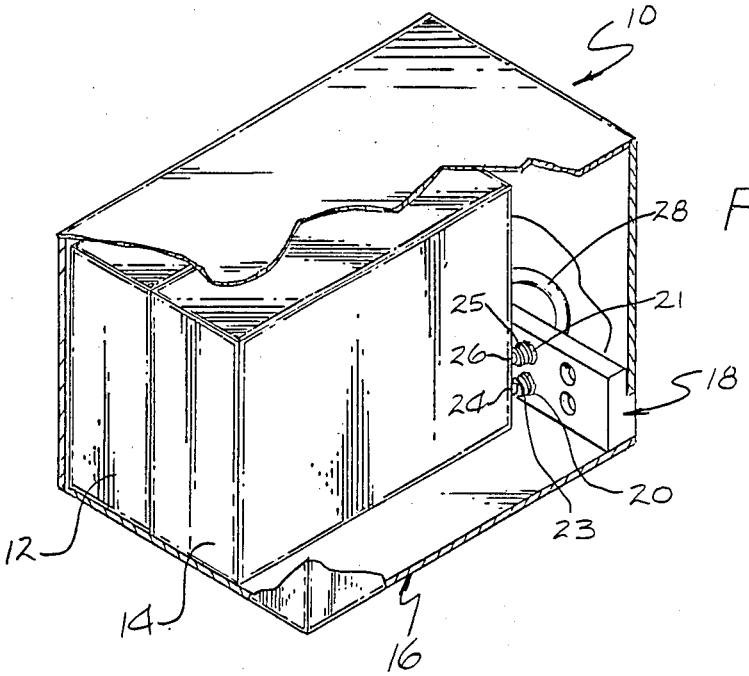
FIG. 1 is a partially cut-away view of a microwave system including various components and the distribution bar of the invention assembled in a housing, with the microwave components being illustrated as various blocks.

Referring to FIG. 1, a microwave network analysis system is generally seen at 10. Generally, microwave network analysis systems are used to measure the microwave characteristic of a particular microwave device, e.g., switches, tunable microwave components, high gain amplifiers or multi-port devices. The various characteristics of microwave devices will affect the overall functioning of a system, e.g., an antenna, in which the microwave devices are incorporated. By knowing the characteristic of each particular microwave device, a systems engineer will be better able to calibrate the overall microwave characteristic for a given system, e.g., a microwave antenna.

The system 10 generally includes multiple microwave energy components, two of which are illustrated in FIG. 1 as blocks 12 and 14, which are situated in a housing 16. The types of components represented by the two blocks 12 and 14 are those which perform a specific function, such as amplification, attenuation or the like.

The system 10 will also include a processor, not shown, which will be able to perform various tasks on the data being developed by the various components of the system 10. For example, the overall characteristics of the microwave energy may by measured prior to introducing the device which is to be tested into the microwave line, e.g., a microwave coaxial cable. The computer will compare the frequency and noise measurements both before and after the inclusion of the device to determine these characteristics of that device. A microwave network analysis system of the type being described is generally well know in the art and is not critical to the invention.

Each of the components 12 and 14 of the system 10 will be independently electromagnetically isolated from the surrounding environment to minimize the potential of either microwave emission by the component or the component receiving extraneous microwave energy. Typically, each of the components is enclosed in a housing formed from an electrically conductive material, i.e., steel or aluminum. The microwave energy upon which the measurement is made is transferred to and/or from the component through a suitable conduit, e.g., a coaxial cable, which runs through this housing.

Also, electrical cables will be run into this housing for either providing the necessary electrical power or establishing data communications with the system computer. The manner by which the microwave components may be electromagnetically shielded, as well as the manner by which the components are coupled to the various microwave transmission cables or the various electrical transmission cable, is known to those skilled in the art and is not critical to the invention.

In accordance with the invention, the system 10 also includes a microwave distribution bar 18 which is assembled to lie at least partially inside the housing 16. The microwave distribution bar 18 is formed with numerous microwave ports, two of which are seen generally at 20 and 21. As will be described in greater detail herein, each one of these ports 20 and 21 is formed to allow microwave energy to pass between a first and second end, neither of which ends are shown. The first end is situated to be accessible from within the housing 16, while the second end is situated to be accessible from outside the housing 16.

Each of the components of the system 10 will be connected to the internally accessible end of at least one of the ports, typically a pair of these ports. Each port functions to either transfer microwave energy to or from that component connected to the respective port. By selectively connecting suitable microwave conduits to the externally accessible ends of the respective ports energy can be transferred between various components and/or the same component.

For example, the component 14 is connected to the ports 20 and 21, with the port 20 functioning as a microwave energy inlet port and the port 21 functioning as a microwave energy outlet port. By connecting the outlet functioning port 20 with another port that is functioning as the microwave energy outlet for another component, e.g., component 12, the microwave energy is transferred from the component 14 to component 12.

Microwave energy is usually transferred to and/or from the system 10, and to its various components, e.g., components 12 and 14, through numerous microwave coaxial cables. Thus the various components of the system 10 will have numerous cables, not shown, connected between their various parts through which microwave energy passes. Each component will also include one or more coaxial cables through which microwave energy is transferred to and/or from that particular component, with two such cables being seen for component 14 at 24 and 26.

As stated, each port of the distribution bar 18 is formed from a connector to which the microwave transmitting conduits may be connected in accordance with known techniques. In the illustrated embodiment, each end of the microwave ports will be formed from a suitable coaxial cable connector, not shown, to which is releasably coupled to an appropriately mateable connector secured to an end of a coaxial cable. For example, the internal end of the ports 20 and 21 is constructed from a coaxial connector which can be releasably mated with a suitable connector mounted to the end of the cables 24 and 26, as seen generally at 23 and 25 respectively.

The interconnection between two ports of the distribution bar 18 is performed by coupling a suitable coaxial cable, one of which is seen at 28, to the externally accessible end of two such ports. This coupling between the cable and port is performed using similar coaxial cable connectors. That is, each end of the coaxial cable 28 has mounted thereto a suitable connector, not shown, which can be mated with the externally accessible end of a suitable coaxial cable connector forming a particular port.

The types of connectors useful for this purpose are known to those skilled in the art and are not critical to the invention. Such connectors include the screw-on, snap-on and slide-on types of connectors.

While the invention has been described with reference to using coaxial cables for delivering microwave energy to the various components of the system 10 the microwave distribution bar 18 may be formed to be compatible for use with microwave conductors other than coaxial cables. In this regard, the various ports of the bar 18 will be suitably formed to allow for the coupling in a manner similar to the manner described above for coaxial cables.

Figure 2:
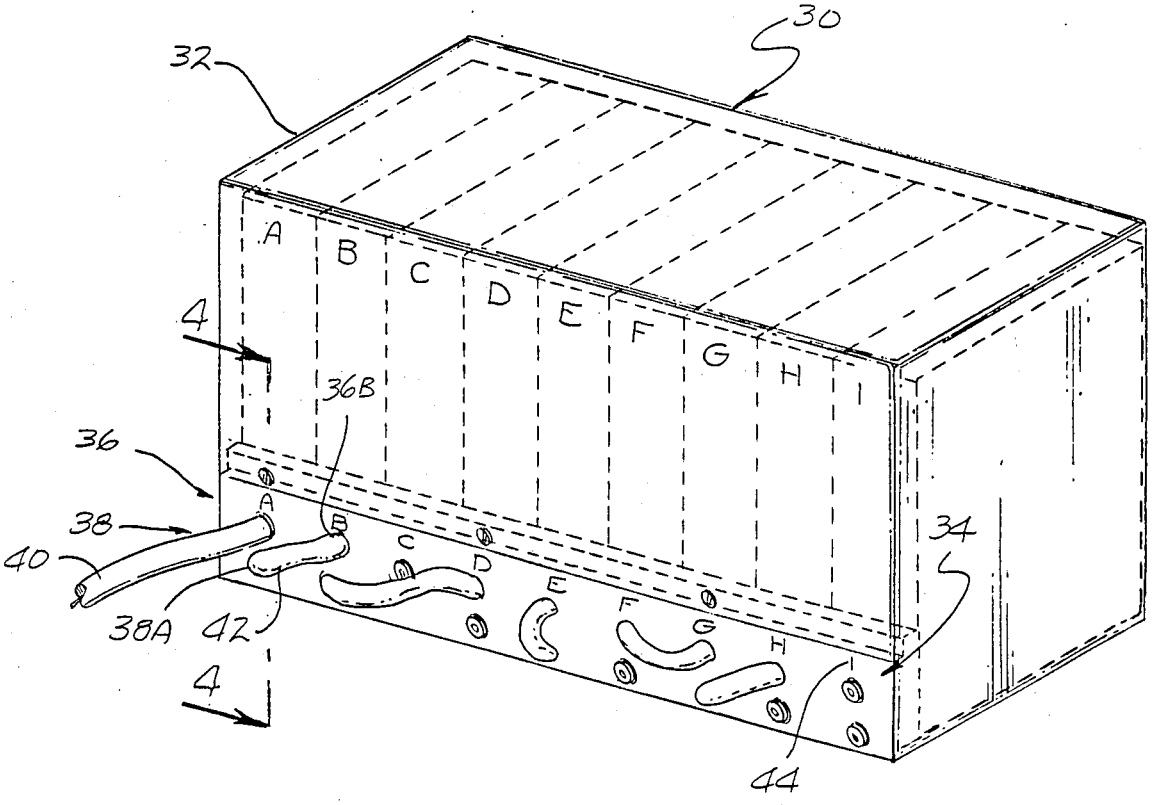
FIG. 2 is a back view of a microwave system housing in which various components are housed with a distribution bar of the invention.

Referring to FIG. 2, a rear view of another embodiment of a microwave network analysis system is seen generally at 30. This system 30 is similar is construction to the system 10 discussed above in that the system 30 includes a number of components used to measure microwave energy characteristics, which components are indicated generally at A through I. These components A–I are shown mounted in a housing 32, along with a microwave distribution bar 34 which is mounted at the rear of the housing 32.

By effectively electromagnetically shielding each of the numerous components A–I from each other, no microwave energy will be emitted from the system 30, nor will extraneous microwave energy affect the microwave measurement being carried out by the individual components A–I.

The distribution bar 34 is formed with two substantially parallel rows of microwave ports, with the first upper row of ports as indicated generally at 36 and a second lower row of ports as indicated at 38. Each row of ports 36 and 38 includes numerous individual ports, with row 36 including the respective ports 36 A–I and row 38 including the respective ports 38 A–I. In the illustrated embodiment each of the system components A–I is coupled to a pair of these ports, that is, one port from each of the rows 36 and 38. This coupling is performed by constructing each of the individual components with two coaxial cables, not shown, that extend out from each component. These two coaxial cables have installed at their ends suitable connectors, also not shown, which can be coupled with the internally accessible end of the desired port.

Typically, the individual connectors are mounted to the individual component at a position substantially in alignment with the port to which the connector is to be coupled. The mounting of the connectors in this manner facilitates the interconnection between the port connector and the cable connector when the component is positioned in the housing 32.

The individual coaxial cables are used for transferring microwave energy to or out of the particular component. In some cases, both of the cables will be used for transferring microwave energy to the component, while in other cases both cables will be used to transfer microwave energy out from the component. The individual ports 36 A–I and 38 A–I are also used to transfer microwave energy either to or out from the individual component. That is, both the individual coaxial cable and the port to which it is coupled will function as a microwave energy inlet or outlet depending upon the particular component.

Microwave energy will be delivered to the system by connecting a source cable to one of the ports of the distribution bar 34, or through an appropriately constructed connector found at the opposite side of the system 30, not shown. Furthermore, more than one source cable may be connected to various components comprising the system 30. Other suitable microwave conduits, other than a coaxial cable may be used to deliver the source microwave energy to the system 30.

For example, a microwave energy source cable 40, which is connected at one end to the microwave device being tested, is coupled with its opposing end to a first of the ports of the bar 34, as illustrated port 36A. This port 36A is connected at its internally accessible end to the component A, and thus the microwave energy will be delivered to the component A for the appropriate measurement.

After the microwave energy has been acted upon by the component A, it may be transferred to any of the other components, back to the same component, or discharge from the system 30 through a suitable conduit. In the illustrated embodiment the microwave energy is transferred to the component B, by the proper connection of a coaxial cable, indicated in phantom at 42, between the port 38A and the port 36B. That is, the port 38A functions as an outlet port, while the port 36B functions as an inlet port. Microwave energy is transferred between selective ones of the numerous components A–I in a like manner.

While the various cables and ports are interconnected by any suitable mechanism, a preferred embodiment of such a mechanism will now be discussed with reference to FIGS. 3 and 4. The mechanism will include various types of elements, e.g., cable mounted connectors (seen generally in FIG. 4) and distribution bar port mounted connectors. The mechanism may also include other elements used to mount the various connectors to the system housings and other structures.

Referring specifically to FIG. 3, a partially crosssectioned side view of a complete interconnection mechanism is seen generally at 50. As will be discussed in greater detail below, the mechanism 50 includes a first element which forms part of the individual ports of the distribution bar, here seen generally at 52, to which other connectors may be coupled at either end. This allows for the selected distribution of microwave energy between the various components of the system. The microwave distribution bar 54 is shown mounted to a wall, indicated at 53, of a device housing by various screws, one of which is seen at 55.

Each port of the distribution bar 54 is defined by apertures, two of which are seen at 70 and 71. A single element 52 which will be referred to as a double stem connector of the mechanism 50 is mounted in each of these apertures 70 and 71.

Each of the double stem connectors 52 is a generally tubular shaped body formed with an outer electrically conductive tubing 56 which surrounds a cylindrical shaped insulating layer 58. While this insulating layer 58 will run the substantial length of the conductive tubing 56, its thickness will vary, with a thicker portion of the layer 58 laying midway between the opposing ends 60 and 62 of the tubing 56, as seen generally at 64.

An elongated filamentous conductor 66 is concentrically positioned in the tubular shaped insulating layer 58 and held in place by being embedded in the insulating layer thicker portion 64. While not running the entire length of the outer conductive tubing 56, the filament 66 will extend out of the opposing sides of the insulating layer thicker portion 64 to allow engagement by the connectors affixed to an appropriate coaxial cable, as will be described in greater detail herein.

Each double stem connector 52 is mounted in the distribution bar 54 by any appropriate means. For example, the conductive tubing 56 may be formed to define an outer threaded portion, generally seen at 68, midway between the tubing 56 opposing ends 60 and 62. This threaded portion 68 engages and grips a threaded portion, seen generally at 69, of the passageway 70 by rotating the connector 52. This rotation is facilitated using a hexagonal shaped collar 57 integrally formed and extending radially out from the tubing 56. A washer 59 may be fitted between the collar 57 and the outer surface of the bar 54.

By providing that the length of the connector 52, in particular the tubing 56, is greater than the girth of the bar 54, a portion of the connector 52 will extend out from the bar 54, as indicated at 72. Furthermore, in accordance with a preferred embodiment of the invention, a portion of each of the passageways 70 and 71 will be formed wider in diameter than the remainder of the passageway 70 or 71 and wider in diameter than the respective connector 52 affixed therein, to form an annular shaped cavity about a respective portion of the connector 52, as indicated generally at 74. As will be described, that component of the mechanism 50 which is mounted to a coaxial cable will be received in this annular shaped cavity 74 and fit snugly about the outer conductive tubing 56.

The second element of the mechanism 50 is a coaxial cable mounted connector, seen generally at 78 and 78'. This connector 78 and 78' is fastened to the free end of a coaxial cable and may be used alone (as connector 78'), or in combination with a wall mount 76 (as is connector 78). The wall mount 76 is secured to a wall, typically the wall of one of the device components, with the cable mounted connector 78 secured therein. As will be described in greater detail herein, the wall mount 76 is loosely affixed to a wall of a particular component to allow for an easy fit into the annular shaped cavity 74 of the bar 54.

Referring to FIG. 4 the cable mounted connector 78 will be described. The connector 78 is constructed from an outer conductive tubing 80 which surrounds a cylindrically shaped insulating layer 82, which itself surrounds an inner conductive core 84. These three portions of the connector 78 are generally concentrically mounted.

The outer tubing 80 is an elongated tube structure in which the insulating layer 82 is positioned. The insulating layer 82 is shorter than the tubing 80 and extends out from a first end 81. That portion of the insulating layer 82 which extends out from the tubing 80 is formed with a first end 83, which is of a lesser diameter than the remainder of the layer 82. This forms a step-like portion at the end 8 of the layer 82. That portion of the tubing 80 in which the layer 82 is not positioned defines a passageway 86. As will be described below, the coaxial cable insulation will be fitted into this passageway 86.

The inner core 84 runs substantially through the insulating layer 82 and extends out from the insulating layer first end 83. That end of the core 84 which extend out from the layer 84 is formed with two opposing prongs 106 and 108. These prongs 106 and 108 are formed to fit snugly about the stem connector filament 66 of a selected double stem connector 52. The opposite end 112 of the core 84 is tubular and dimensioned to snugly receive an inner coaxial cable conductive core. This tubular end 112 is recessed in the insulation layer 82. That portion of the layer 82 in which the tubular end 112 is recessed defines an aperture 114 which is dimensioned to receive the inner coaxial cable conductive core.

The connector 78 is also formed with a crimp cylinder 110 which fits about the outer conductor 80. The crimp cylinder 110 lies along that portion of the conductor 80 opposite its first end 81. This positions the crimp cylinder 110 about that portion of the conductor 80 in which is placed the insulation of a coaxial cable. As will be discussed, the coaxial cable outer conductive layer may be placed between the outer conductor 80 and the crimp cylinder 110.

This cable mounted connector 78 is mounted to the end of the coaxial cable 88 by stripping back a outer insulating sheathing 85 to expose a outer conductive layer 87, an insulation layer 89 and an inner conductor 91. A short length of the inner conductor 91 is exposed at the coaxial cable end. This short length of the inner conductor 91 is dimensioned to fit through the connector insulation layer aperture 114 and into the inner conductor tube end 112 when the coaxial cable insulation layer 89 is placed into the connector outer conductive tubing passageway 86. This places the coaxial cable insulation 89 in physical contact with the connector insulation layer 82. The outer conductive layer 87 is forced to lie between the connector outer conductive tubing 80 and the crimp cylinder 110. The crimp cylinder 110 is crimped down upon the outer cable conductor 87.

In this manner the connector 78 and coaxial cable 88 form a continuous microwave transmitting structure. The cable outer conductor 87 and connector outer conductive tubing 80 form the outer conductor, with the core 84 and coaxial cable inner conductor 91 forming the inner conductor. A continuous insulative membrane is formed by the physically connected connector layer 82 and coaxial cable insulation 89. This insures integrity between the cable mounted connector 78 and the coaxial cable 88, which insures the integrity of the passage of the microwave energy through the coaxial cable and the mechanism 50 of the invention.

Referring now to FIGS. 3 and 4, the cable mounted connector 78 may be fitted into the wall mount 76. Typically the connector 78 includes threads 90 which are formed along the surface of the outer tubing 80. These threads 90 are received in a compatibly threaded portion, not shown, of a passageway 96 defined through the wall mount 76. This allows for the mounting of the cable mounted connector 78 in the wall mount 76. The connector 78 is also formed with a hexagonal shaped collar 116 contiguous to the threads 90 to facilitate the threading of the connector 78 into the wall mount 76.

The wall mount 76 includes a conductive tube 92 that is formed with an outer threaded portion, seen generally at 94, and an outward extending flange 102. The threaded portion 94 is loosely positioned in an aperture, seen in phantom at 98, formed, for example, through a wall 100 of a particular component A–I of FIG. 2. This aperture 98 is slightly wider than the diameter of the tube 92 forming the wall mount 76 in order to provide a loose fit.

The wall mount 76 is affixed in this aperture 98 by placing the flange 102 in abutment with the wall 100. As illustrated, a washer 103 is placed between the flange 102 and the wall 100 with the flange 102 abutting the washer 103. A nut and washer assembly, seen generally at 104, is threaded along the threaded portion 94 toward and against the opposing side of the wall 100 to affix the segment 76 in place.

A tubular spacer 105 is loosely fitted about the threaded portion 94 of the wall mount 76. This spacer 105 is dimensioned for loose fit in the aperture 98 and to be affixed between the opposing nut and washer assembly 104 and the washer 103. This ensures that the wall mount 76 is loosely affixed in the aperture 98 of the wall 100, thus allowing for a slight lateral movement of the wall mount 76 in both the vertical and horizontal direction. The usefulness of this manner of securing the wall mount 76 in the wall aperture 98 will be discussed below.

The mating of the two components of the coupling mechanism 50 is performed by sliding the wall mount 76 over the conductive tubing 56 of the double stemmed connector 52. The inner diameter of the tubing of the wall mount 76 and the outer diameter of the conductive tubing 56 should be provided to ensure a snug fit between the two. However, the outer diameter of the wall mount 76 should be such to allow it to fit in the annular shaped cavity formed between the tubing 56 and the wall defining the passageway 71.

Further, the inner core 84 of the cable mounted connector 78 should be sized to fit snugly about the inner conductor 66 of the double stemmed connector 52.

By mating another cable mounted component, which may be of a similar construction or of any suitable construction to the opposite end of the double stemmed connector 52, a continuous microwave conduit is formed between two microwave coaxial cables, thus insuring the proper transmission of microwave energy from one coaxial cable to another.

In accordance with a more preferred embodiment, the connecting mechanism 50 described above is formed to promote the mating between the wall mount 76 and one end of the double stemmed connector 52. In this embodiment the surface of the bar 54 defining the annular shaped cavities of the individual ports are formed to allow the tube 92 to bear against and, by way of the loose fit of the wall mount 76, be cammed into the annular shaped cavity and engage the respective end of the double stemmed connector 52.

This camming surface, seen generally 110, is defined about the annular shaped cavity 111 of the passageway 71 contiguous to the exterior surface of the bar 54. This camming surface 110 is angled to direct the wall mount 76 into the annular cavity 111 and thus into a mating alignment with the end of the double stemmed connector 52. This camming surface 110 is preferentially an inwardly converging conical shaped surface.

The microwave distribution bar of the invention is formed to allow a user of the system to identify which of the various system components is connected to a particular port. The user can then properly select which of the particular components to access via the individual ports.

One manner to allow this identification is illustrated in FIG. 2. The bar 43 is formed with numerous indicia, with each of the individual indicia located contiguous to one of the individual ports, with one such indicia for the port 37I being seen generally at 44. Thus, the user can identify which component will be accessed by knowing which component is connected to which indicia displayed port.

Another manner by which the individual components may be identified is to form the distribution bar from a transparent material, i.e., polycarbonate. By properly marking that surface of each of the components at a location adjacent to the distribution bar, the user can visually observe the identity of each particular component.

While the preferred embodiment has been described and illustrated, various substitutions and modifications may be made thereto without departing from the scope of the invention. Accordingly, it is to be understood that the present invention has been described by way of illustration and not limitation.

What is claimed is:

1. In a microwave frequency network analyzer having a plurality of individual modules, assembled within a housing, at least some of said modules including microwave components, all of said modules including non-microwave components operating at ratio frequencies lower than microwave frequencies, each of said modules having a plurality of connectors at one surface thereof for conveying signals to and/or from said microwave components and said non-microwave components; a distribution bar for receiving said plurality of connectors on each of said modules and for use in conveying said signals to, from and between said individual modules, said distribution bar comprising:

an elongated bar of insulating material mounted in said housing at a location against which is placed that surface of each of said modules having said connectors when said modules are in operative position within said housing, a plurality of microwave conduit connectors each mounted within said bar for conducting microwave energy therethrough and receiving said connectors on said modules associated with microwave signals, each of said connectors including oppositely located first and second conduit mateable members, said first conduit mateable member being accessible from within said housing and positioned for releaseable connection to one of said connectors mounted in the module positioned adjacent thereto and associated with a microwave component contained therein, said second conduit mateable member being accessible from outside of said housing, said bar being formed from an insulative material which electrically isolates each of said connectors carrying microwave energy from adjacent connectors to prevent the microwave energy from interfering with signals carrried by said adjacent connectors; and a plurality of microwave transmitting conduits which are each formed with two opposing ends that can each be releasably connected to selected ones of said second conduit mateable members, whereby microwave energy is transmitted between selected ones of said modules received by said bar and connected to the associated first conduit mateable member.

2. The device of claim 1 wherein each of said connectors is mounted in said bar to ensure alignment of said first conduit mateable members with a respective one of said connectors at said surface of said module.

3. The device of claim 2 wherein each connector is mounted in an aperture formed in said bar, which aperture includes an end positioned about said first conduit mateable member which is formed with a surface upon which said respective module connector bears and is directed into mating engagement with said first conduit mateable member, and wherein said module connector is resiliently mounted on said module surface for lateral movement, whereby said module connector laterally moves as it travels across said aperture surface to allow the same to mate with said first conduit mateable member.

4. The device of claim 3 wherein said aperture surface is an inwardly converging conical surface.

* * * * *